United States Patent [19]

Hisao et al.

[11] Patent Number: 4,969,512

[45] Date of Patent: Nov. 13, 1990

[54] HEAT EXCHANGER

[75] Inventors: Aoki Hisao, Maebashi; Ando Nobuyasu, Takasaki, both of Japan

[73] Assignee: Sanden Corporation, Isesaki, Japan

[21] Appl. No.: 297,323

[22] Filed: Jan. 17, 1989

[30] Foreign Application Priority Data

Jan. 22, 1988 [JP] Japan ..... 63-5944[U]

[51] Int. Cl.[5] ..... F28D 1/02

[52] U.S. Cl. ..... 165/153; 165/152; 165/175

[58] Field of Search ..... 165/152, 153, 175; 62/515, 516, 517

[56] References Cited

U.S. PATENT DOCUMENTS

| | | | |
|---|---|---|---|
| 3,254,708 | 6/1966 | Oddg | 165/153 |
| 3,521,707 | 7/1970 | Brown | 165/152 |
| 4,258,785 | 3/1981 | Beldam | 165/153 X |
| 4,587,701 | 5/1986 | Koisuka et al. | 29/157.3 A |
| 4,620,590 | 11/1986 | Koisuka et al. | 165/150 |
| 4,723,601 | 2/1988 | Ohara et al. | 165/153 |

*Primary Examiner*—Lloyd L. King

*Attorney, Agent, or Firm*—Banner, Birch, McKie & Beckett

[57] ABSTRACT

An evaporator for an automotive air conditioning refrigerant circuit is disclosed. The evaporator includes a plurality of flat pipes through which refrigerant flows, and corrugated metal sheets are disposed between the flat pipes. A plurality of linking members are hermetically fixed at both opening ends of the flat pipes and are also heremetically fixed to each other to facilitate communication between adjacent flat pipes.

5 Claims, 6 Drawing Sheets

HEAT EXCHANGER

BACKGROUND OF THE INVENTION

1. Field of the Invention

This invention relates generally to heat exchangers for refrigerant circuits, and more particularly, to an evaporator for an automotive air conditioning refrigerant circuit.

2. Description of the Prior Art

In the past, a serpentine type evaporator, such as shown in FIG. 1, has been used as an evaporator in automotive air conditioning refrigerant circuits. As illustrated in FIG. 1, serpentine type evaporator 100 includes a serpentined flat pipe 200 having corrugated metal sheets 300 disposed between adjacent portions of the flat pipe. In this type of evaporator, refrigerant flow through the serpentined flat pipe is serial only so that considerable pressure loss takes place within the pipe. This pressure loss then increases the compressor load needed to maintain the appropriate refrigerant ability of the refrigerant circuit.

Another prior art evaporator is the laminate type evaporator, disclosed in Japanese Utility Model Application 54-3655, which includes a plurality of thin parallelepiped-shaped tanks. This evaporator requires use of a considerably expensive mold for forming the various tanks. Thus, when the laminate type evaporator is used for an automotive refrigerant circuit, which requires frequent design changes, production costs may be significantly increased.

SUMMARY OF THE INVENTION

It is an object of this invention to provide an evaporator which can be easily and flexibly (i.e., with respect to the length and number of flat pipes and the refrigerant flow) designed without substantial production costs.

An evaporator for an automotive air conditioning refrigerant circuit in accordance with this invention includes a plurality of flat pipes through which refrigerant flows. At least one heat receiving plate is disposed between the flat pipes, and a plurality of linking members are hermetically fixed at both opening ends of the flat pipes. The linking members are also hermetically fixed to each other to facilitate communication between adjacent flat pipes.

DETAILED DESCRIPTION OF THE PREFERRED EMBODIMENT

Figure 1:
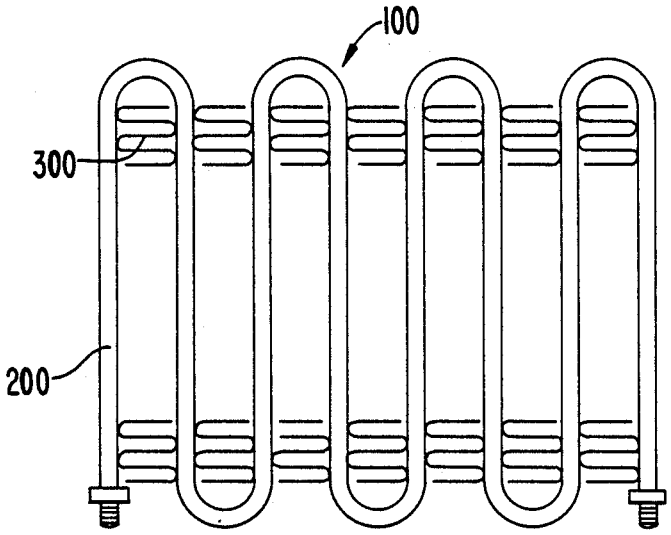
FIG. 1 is a front elevation of a serpentine type evaporator in accordance with the prior art. In the drawing, intermediate portions of a corrugated metal sheet are omitted.
Figure 2:
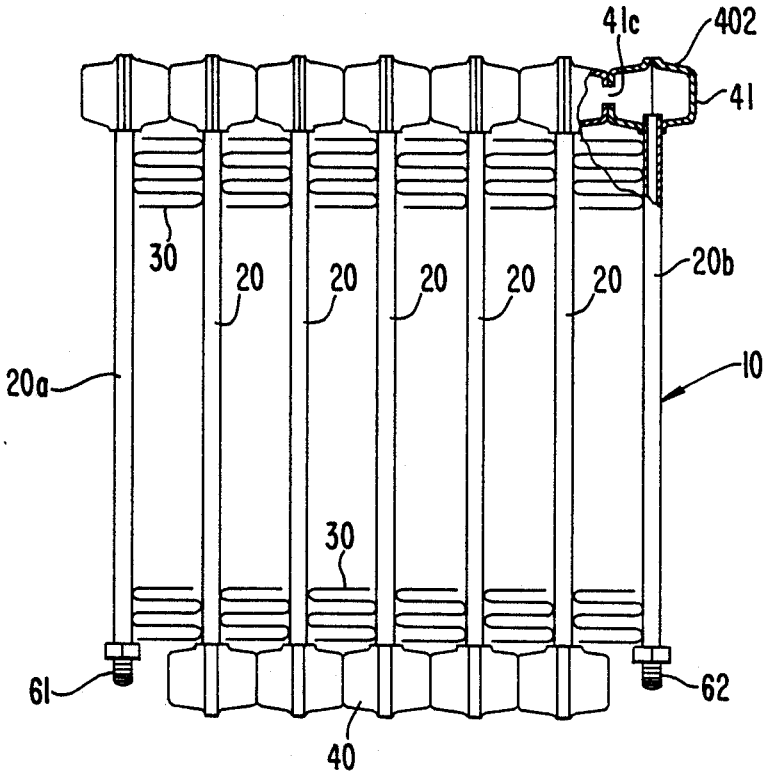
FIG. 2 is a front elevation partly in section of an evaporator in accordance with a first embodiment of this invention. In the drawing, intermediate portions of a corrugated metal sheet are omitted.

The construction of evaporator 10 of an automotive air conditioning refrigerant circuit in accordance with one embodiment of the present invention is shown in FIG. 2.

Figure 3:
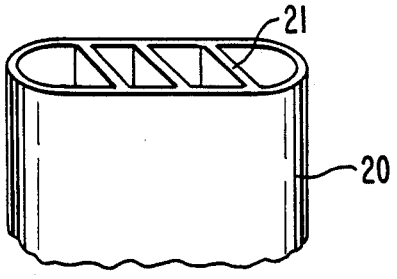
FIG. 3 is a grossly enlarged partial perspective view of a flat pipe.

Evaporator 10 includes a plurality of flat pipes 20, heat receiving plates 30 disposed between flat pipes 20 and a plurality of linking members 40 located at the opening ends of flat pipes 20. An inner space of flat pipes 20 through which the refrigerant flows is divided into a plurality of small passages by a plurality of vertical partition walls 21, as shown in FIG. 3. Heat receiving plates 30 are provided for receiving heat from air passing through evaporator 10, and are fixed to the side walls of flat pipes 20 by brazing. In the preferred embodiment, heat receiving plates 30 are constructed of corrugated metal. Outermost flat pipes 20*a*, 20*b* are provided with female screw portions 61, 62, respectively, at one opening end thereof to connect to other apparatus of the refrigerant circuit (not shown).

Figure 4:
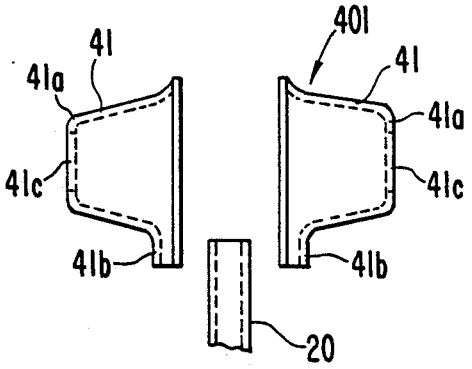
FIGS. 4 and 5 are partial front elevations of an evaporator in accordance with a first embodiment of this invention.
Figure 5:
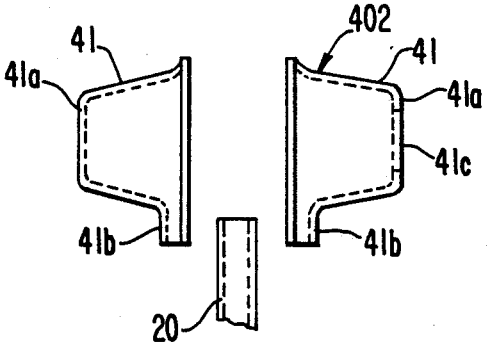
Figure 6:
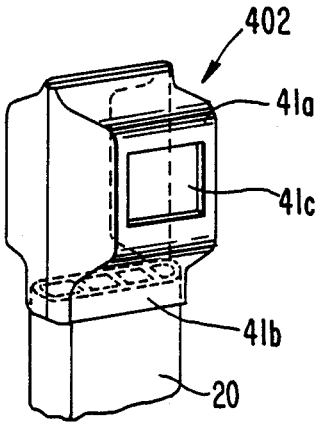
FIG. 6 is a grossly enlarged partial perspective view of an evaporator in accordance with a first embodiment of this invention.

With reference to FIGS. 4, 5, and 6, linking member 40 includes a pair of shells 41 hermetically fixed to each other at the opening ends thereof by brazing. Each shell 41 comprises a cup-shaped portion 41*a* and a handle portion 41*b*. During the fabrication process, the handle portions 41*b* of a pair of shells 41 are simultaneously hermetically secured to one end of flat pipes 20 by brazing. Cup-shaped portion 41*a* has a flat bottom surface and a hole 41*c* is provided therein. Adjacent linking members 40 are fixedly secured to one another at the bottom surfaces of the respective cup-shaped portions 41*a* by brazing, so that adjacent holes 41*c* are hermetically linked. The opening area of hole 41*c* is made sufficiently large to avoid pressure loss.

Figure 7:
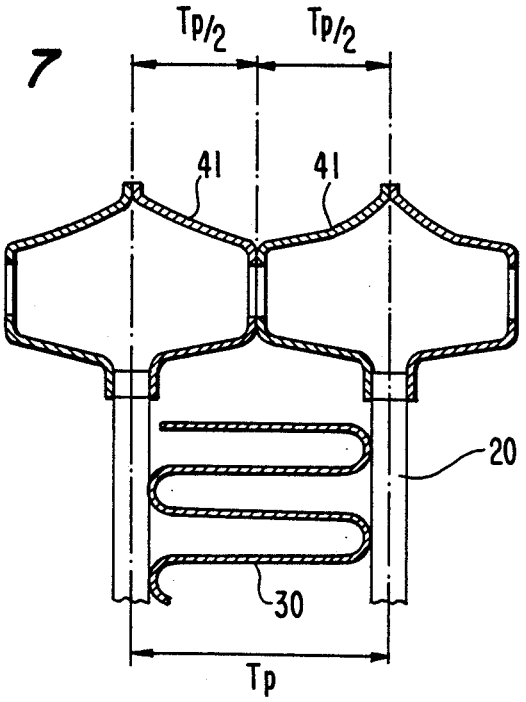
FIG. 7 is a grossly enlarged partially sectional view of an evaporator in accordance with a first embodiment of this invention.

Assembly of evaporator 10 proceeds as follows. First, a plurality of linking members 40 are fixed at both ends of a plurality of flat pipes 20. Then, flat pipes 20 and heat receiving plates 30 are alternately piled. Shells 41 are appropriately dimensioned as shown in FIG. 7 to ensure against gaps occuring between adjacent linking members 40 and between heat receiving plates 30 and flat pipes 20. After piling, the assembled elements are temporarily fixed using a jig to maintain their position. The elements are then placed in a brazing furnace and heated to 600° C. (linking members 40 and heat receiving plates 30 are formed of a clad aluminum alloy which melts at 600° C.) to hermetically fix the various elements to adjacent structure as described above.

Figure 8:
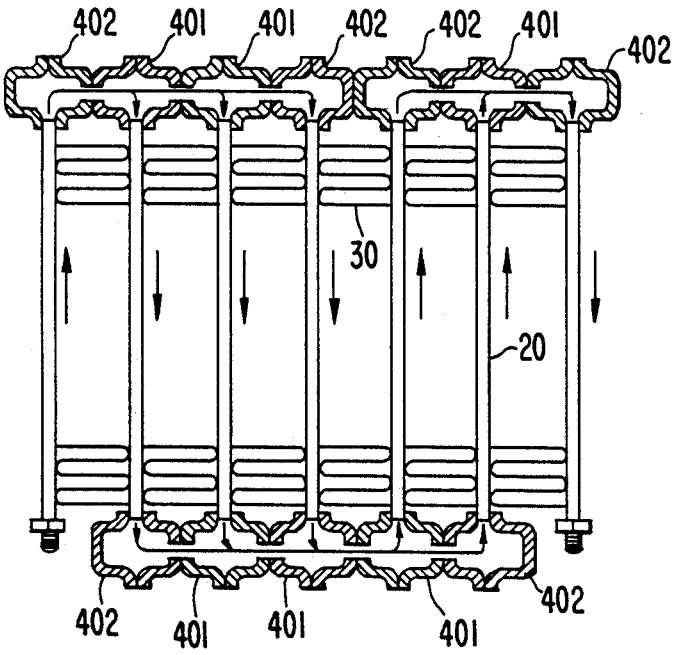
FIG. 8 is a front elevation partly in section of an evaporator in accordance with a first embodiment of this invention. In the drawing, intermediate portions of a corrugated metal sheet are omitted.

Linking members 40 are of either a first type 401 or a second type 402. A linking member of first type 401, as shown in FIG. 4, includes holes 41*c* formed in the bottom surface of each of shells 41 of the pair of shells. A linking member of second type 402 is shown in FIG. 5 and includes only one hole 41*c* formed in the bottom surface of one of the shells 41. When only the second type linking member 402 is used, refrigerant flow in evaporator 10 is serial. However, when both first and second type linking members 401, 402 are used, refrigerant in evaporator 10 may flow in parallel. Further, both first and second type linking members 401, 402 can be appropriately used to create both serial and parallel flow of refrigerant in evaporator 10 as shown in FIG. 8. By increasing the parallel flow of refrigerant in evaporator 10, pressure loss is reduced.

Figure 9:
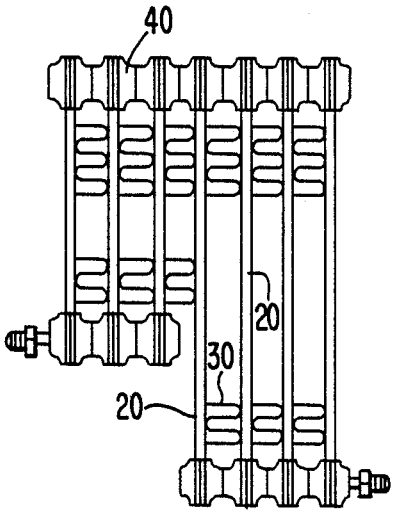
FIG. 9 is a front elevation of an evaporator in accordance with a second embodiment of this invention.

It should be understood that the number of flat pipes 20 and the length of flat pipes 20 can be readily changed within the scope of this invention as shown in FIG. 9.

Figure 11:
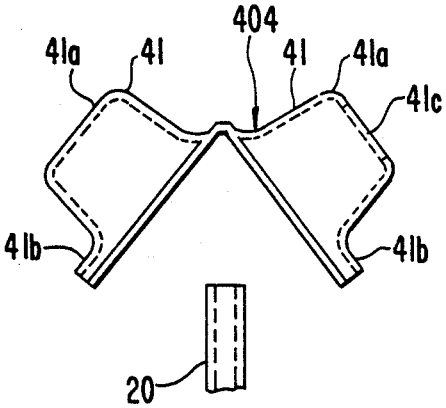
FIGS. 10 and 11 are partial front elevations of an evaporator in accordance with a third embodiment of this invention.
Figure 10:
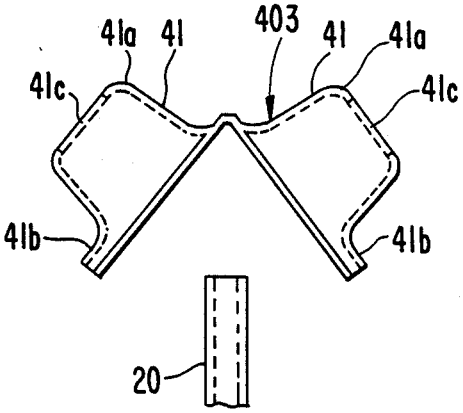

FIGS. 10 and 11 show an arrangement in which the edges of cup-shaped portions 41*a* of shells 41 are flexibly joined.

We claim:

1. An evaporator of a refrigerant circuit comprising:

a plurality of flat pipes through which refrigerant flows;

at least one heat receiving plate disposed between said flat pipes;

a plurality of linking members disposed at both opening ends of the flat pipes for permitting communication between adjacent ones of said flat pipes, at least one of said first linking members including first aperture means for communicating with an adjacent linking member on only one side thereof, and the other linking members including second aperture means for communicating with an adjacent linking member on both sides thereof.

2. The evaporator of claim 1 wherein each of said linking members includes a pair of shells, each of said shells having one open end which faces the open end of the other shell.

3. The evaporator of claim 2 wherein each shell of said pair of shells includes a portion for fixing the shell to an opening end of said flat pipe.

4. The evaporator of claim 3 wherein the shells of said pair of shells are flexibly joined at respective portions thereof opposite the fixing portions.

5. The evaporator of claim 1 wherein the length of at least one of said flat pipes is equal to a first length and the length of the other flat pipes is equal to a second length different than the first length.

* * * * *